US006016864A

United States Patent [19]

Bae et al.

[11] Patent Number: 6,016,864

[45] **Date of Patent: *Jan. 25, 2000**

[54] HEAT EXCHANGER WITH RELATIVELY FLAT FLUID CONDUITS

[75] Inventors: Young L. Bae, Scobey; Michael E. Heidenreich, Grenada; Roger A. Loomis, Hernando; Benjamin W. McElwrath, Jr., Grenada, all of Miss.

[73] Assignee: Heatcraft Inc., Grenada, Miss.

[ * ] Notice: This patent is subject to a terminal disclaimer.

[21] Appl. No.: 09/095,039

[22] Filed: Jun. 10, 1998

Related U.S. Application Data

[63] Continuation-in-part of application No. 08/634,777, Apr. 19, 1996, Pat. No. 5,771,964.

[51] Int. Cl.[7] ..... F28F 1/02

[52] U.S. Cl. ..... 165/144; 165/177; 165/DIG. 537; 165/DIG. 456; 165/DIG. 457

[58] Field of Search ..... 165/144, 177, 165/DIG. 456, DIG. 457, DIG. 537, 168, 170, 175; 29/890.049

[56] References Cited

U.S. PATENT DOCUMENTS

| | | | |
|---|---|---|---|
| 178,300 | 6/1876 | Jas . | |
| 314,945 | 3/1885 | Korting . | |
| 1,884,612 | 10/1932 | Dinzl . | |
| 1,958,899 | 5/1934 | MacAdams . | |
| 2,017,201 | 10/1935 | Bossart et al. . | |
| 2,521,475 | 9/1950 | Nickolas . | |
| 3,153,447 | 10/1964 | Yoder et al. . | |
| 3,662,582 | 5/1972 | French . | |
| 3,776,018 | 12/1973 | French . | |
| 4,932,469 | 6/1990 | Beatenbough . | |
| 4,998,580 | 3/1991 | Guntly et al. | 165/133 |
| 5,185,925 | 2/1993 | Ryan et al. | 29/890.049 |
| 5,372,188 | 12/1994 | Dudley et al. | 165/10 |
| 5,456,006 | 10/1995 | Study | 29/890.049 |
| 5,586,598 | 12/1996 | Tanaka et al. . | |
| 5,771,964 | 6/1998 | Bae | 165/144 |

FOREIGN PATENT DOCUMENTS

| | | |
|---|---|---|
| 57-174696 | 10/1982 | Japan . |
| 1 570 033 | 6/1980 | United Kingdom . |

*Primary Examiner*—Allen Flanigan
*Attorney, Agent, or Firm*—W. Kirk McCord

[57] ABSTRACT

An improved heat exchanger (60) includes plural relatively flat conduits (62) adapted to accommodate passage of heat transfer fluid therethrough. Each conduit (62) has inlet and outlet openings, a supply channel (100) communicating with the corresponding inlet opening to direct heat transfer fluid flowing through the corresponding inlet opening into the corresponding conduit (62), a drain channel (102) communicating with the corresponding outlet opening to direct heat transfer fluid out of the corresponding conduit (62) through the corresponding outlet opening, and plural heat transfer channels (92) communicating between the supply and drain channels (100, 102) to direct heat transfer fluid therebetween in a generally transverse direction relative to respective major axes of the supply and drain channels (100, 102). The supply and drain channels (100, 102) each have a substantially greater length and cross-sectional area than the length and cross-sectional area of each heat transfer channel (92). Heat transfer between the fluid inside the conduit (62) and an external fluid, such as air, flowing through the heat exchanger (60) occurs for the most part as heat transfer fluid flows through the heat transfer channels (92) of the conduits (62).

37 Claims, 11 Drawing Sheets

HEAT EXCHANGER WITH RELATIVELY FLAT FLUID CONDUITS

CROSS-REFERENCE TO RELATED APPLICATION

This application is a continuation-in-part of co-pending application Ser. No. 08/634,777, filed Apr. 19, 1996, now U.S. Pat. 5,771,964.

FIELD OF INVENTION

This invention relates generally to heat exchangers having one or more relatively flat fluid conduits and in particular to a heat exchanger with improved fluid conduits.

BACKGROUND ART

Heat exchangers having fluid conduits of relatively flat cross-section are known in the art. Such heat exchangers are often referred to as "parallel flow" heat exchangers. In such parallel flow heat exchangers, the interior of each tube is divided into a plurality of parallel flow paths of relatively small hydraulic diameter (e.g., 0.070 inch or less), to accommodate the flow of heat transfer fluid (e.g., a vapor compression refrigerant) therethrough. Parallel flow heat exchangers may be of the "tube and fin" type in which the flat tubes are laced through a plurality of heat transfer enhancing fins or of the "serpentine fin" type in which serpentine fins are coupled between the flat tubes. Heretofore, parallel flow heat exchangers typically have been used as condensers in applications where space is at a premium, such as in automobile air conditioning systems.

To enhance heat transfer between fluid such as a vapor compression refrigerant flowing inside the heat exchanger conduits and an external fluid such as air flowing through the heat exchanger, it is usually advantageous to have flow channels of relatively small hydraulic diameter. However, such small hydraulic diameters usually result in unwanted pressure drops as the fluid flows through the conduits. There is therefore a need for an improved heat exchanger to provide the advantages of relatively small hydraulic diameter flow paths, without the pressure drops which are usually associated with such relatively small hydraulic diameter flow paths.

SUMMARY OF THE INVENTION

In accordance with the present invention, a heat exchanger is provided having at least one conduit of non-circular cross-section adapted to accommodate passage of heat transfer fluid therethrough and support means for supporting the conduit. The conduit has a major dimension and a minor dimension, inlet and outlet openings, a supply channel extending along the major dimension and communicating with the inlet opening to direct heat transfer fluid flowing through the inlet opening into the conduit, a drain channel extending along the major dimension and communicating with the outlet opening to direct heat transfer fluid out of the conduit through the outlet opening, and plural heat transfer channels, each of which extends along the minor dimension between the supply channel and the drain channel. The heat transfer channels are adapted to direct heat transfer fluid from the supply channel to the drain channel in a transverse direction with respect to the major dimension.

In accordance with a feature of the invention, a corrugated member having plural corrugations defining the heat transfer channels is located in the conduit. The conduit is assembled by folding a relatively flat plate along a major axis thereof which is intermediate opposed side edges of the plate to form one side of the conduit, inserting the corrugated member into the conduit and joining the opposed side edges of the plate to form an opposite side of the conduit from the aforementioned one side. The corrugated member has a length extending along substantially the entire major dimension of the conduit and a width extending only partially along the minor dimension of the conduit. The supply channel is intermediate the corrugated member and one side of the conduit and the drain channel is intermediate the corrugated member and an opposite side of the conduit. In the preferred embodiment, the corrugations are arranged in a tightly packed configuration to define plural teardrop-shaped heat transfer channels.

In accordance with another feature of the invention, the major dimension is substantially greater than the minor dimension, such that each transfer channel has a relatively short length compared to a length of the conduit along the major dimension. Further, the supply channel and the drain channel each have a substantially greater cross-sectional area than each of the heat transfer channels. The supply channel and the drain channel have respective major axes which are parallel to the major dimension of the conduit and are located on respective opposed sides of the conduit. In the preferred embodiment, the length of the conduit along the major dimension is at least six times greater than the length of each heat transfer channel along the minor dimension and the cross-sectional area of the conduit is at least five times greater than the cross-sectional area of each of the heat transfer channels.

In accordance with still another feature of the invention, the conduit is supported by inlet and outlet headers having respective curved front walls in facing relationship. The conduit extends between the inlet and outlet headers, with one end of the conduit penetrating through a slot in the front wall of the inlet header and an opposite end of the conduit penetrating through a slot in the front wall of the outlet header. The inlet header also has a rear wall, a portion of which is joined to the one end of the conduit to block the drain channel, whereby heat transfer fluid is inhibited from entering the drain channel from the inlet header. The outlet header also has a rear wall a portion of which is joined to the opposite end of the conduit to block the supply channel whereby heat transfer fluid is inhibited from entering the outlet header through the supply channel.

In accordance with the present invention, an improved heat exchanger is provided, having a conduit with supply and drain channels, which are sufficiently large in cross-sectional area to maintain a required fluid flow rate in the conduit, and plural heat transfer channels of relatively small hydraulic diameter, to enhance heat transfer between the fluid as it flows through the heat transfer channels and an external fluid, such as air, moving through the heat exchanger. Because the heat transfer channels extend between the supply and drain channels (i.e., across the minor dimension of the conduit), they are relatively short in length compared to the lengths of the supply and drain channels. Therefore, the heat transfer channels can have relatively small hydraulic diameters without excessive pressure drops occurring as the fluid flows through the heat transfer channels.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
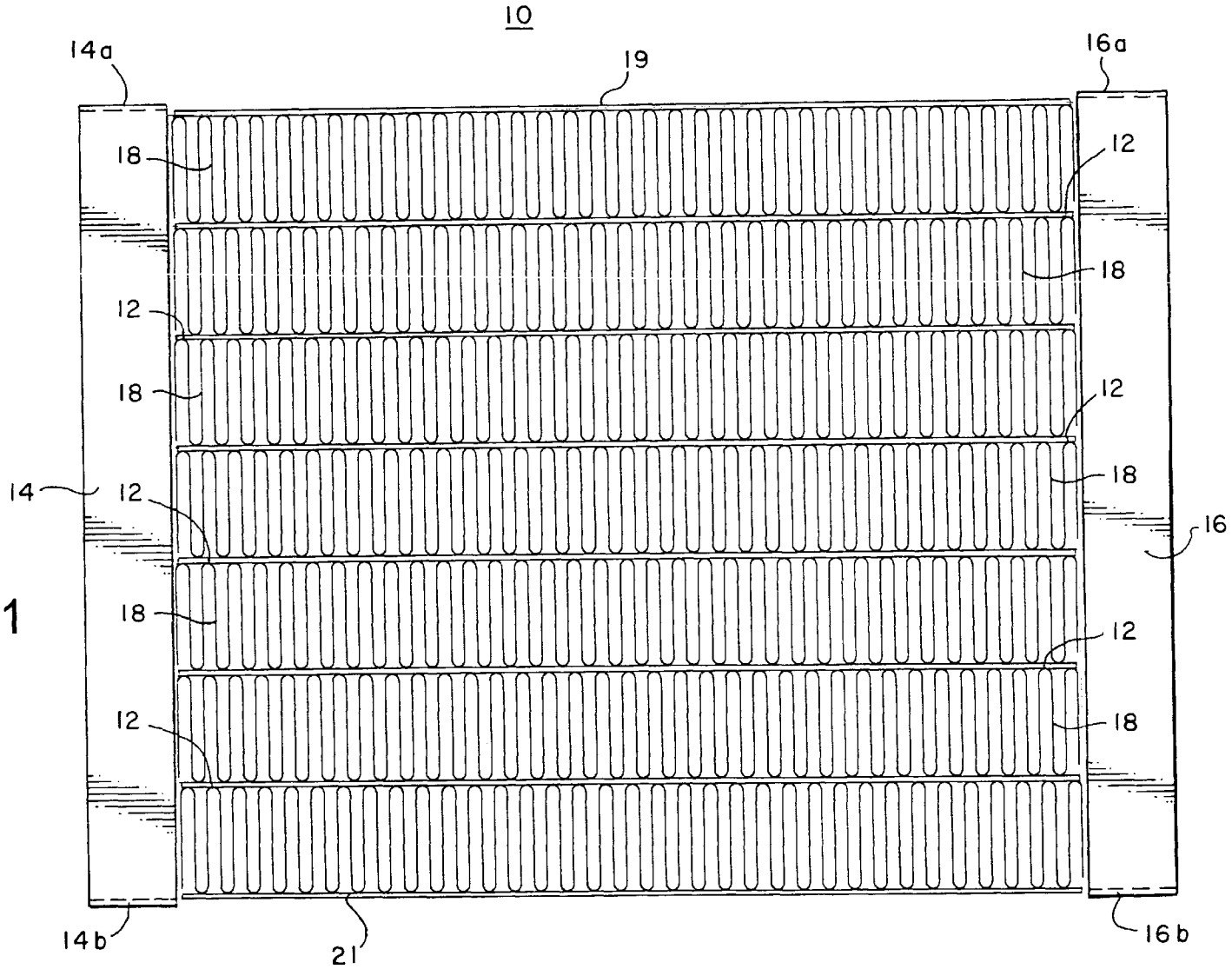
FIG. 1 is a side elevation view of an improved heat exchanger with plural relatively flat fluid conduits, according to the present invention.

Referring to FIG. 1, a heat exchanger 10, according to the present invention, is comprised of a plurality of elongated tubes 12 of non-circular cross-section extending between opposed inlet and outlet headers 14 and 16, respectively. Tubes 12 are preferably made of metal, such as aluminum or copper. Inlet and outlet headers 14 and 16 function as support members for supporting the weight of tubes 12. Inlet header 14 has top and bottom caps 14*a* and 14*b* to close off the top and bottom of inlet header 14. Outlet header 16 has top and bottom caps 16*a* and 16*b* to close off the top and bottom of outlet header 16. A plurality of heat transfer enhancing, serpentine fins 18 extend between and are bonded, for example, by brazing, to adjacent ones of tubes 12 and are supported thereby. Fins 18 are preferably made of metal, such as aluminum or copper. Heat exchanger 10 further includes a top plate 19 and a bottom plate 21. The uppermost fins 18 are bonded to top plate 19 and to the uppermost tube 12. The lowermost fins 18 are bonded to the lowermost tube 12 and to bottom plate 21.

Referring also to FIGS. 2–7, each tube 12 has an inlet opening 22 at one end 12*a* thereof and an outlet opening 24 at an opposite end 12*b* thereof. Inlet opening 22 is in fluid communication with inlet header 14 (FIG. 1) and outlet opening 24 is in fluid communication with outlet header 16 (FIG. 1), whereby heat transfer fluid (e.g., a vapor compression refrigerant) is able to flow from inlet header 14 through inlet opening 22 of each tube into the corresponding tube 12 and is able to flow out of each tube 12 through outlet opening 24 of the corresponding tube 12 into outlet header 16.

Figure 5:
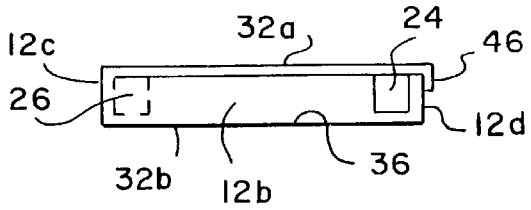
FIG. 5 is an outlet end elevation view of the conduit of FIG. 2.
Figure 4:
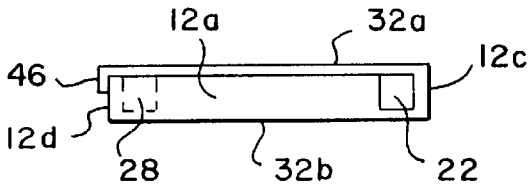
FIG. 4 is an inlet end elevation view of the conduit of FIG. 2.

Each tube 12 is relatively flat and has a substantially rectangular cross-section, as can be best seen in FIGS. 4 and 5. Each tube 12 has a major dimension extending between inlet and outlet ends 12*a* and 12*b* thereof and a minor dimension extending between opposed sides 12*c* and 12*d* thereof A supply channel 26 extends along the major dimension of each tube 12, adjacent side 12*c* thereof, and a drain channel 28 extends along the major dimension of each tube 12, adjacent side 12*d* thereof A plurality of heat transfer channels 30 in parallel array extend along the minor dimension of tube 12 between supply and drain channels 26 and 28. Relatively thin walls 32 separate adjacent channels 30. As can be best seen in FIG. 3, each channel 30 has a generally parallelogram-shaped cross-section.

In accordance with a feature of the invention, each heat transfer channel 30 has a relatively small hydraulic diameter, preferably in a range of 0.01 to 0.20 inch. However, in heat exchangers used in large air handling units, such as those used for commercial applications, the hydraulic diameter of each heat transfer channel may be larger than 0.20 inch Supply and drain channels 26 and 28 each have a substantially greater cross-sectional area than the cross-sectional area of each channel 30 so as to maintain sufficient fluid flow rate through channels 30 without excessive pressure drops. For example, the cross-sectional area of each channel 26, 28 may be in a range of 5–100 times greater than the cross-sectional area of each channel 30. Hydraulic diameter (HD) is computed according to the following generally accepted formula:

$$HD = \frac{4 \times A}{WP}$$

Where HD=hydraulic diameter

A=cross-sectional area of the corresponding channel

WP=wetted perimeter of the corresponding channel cross-section

Figure 6:
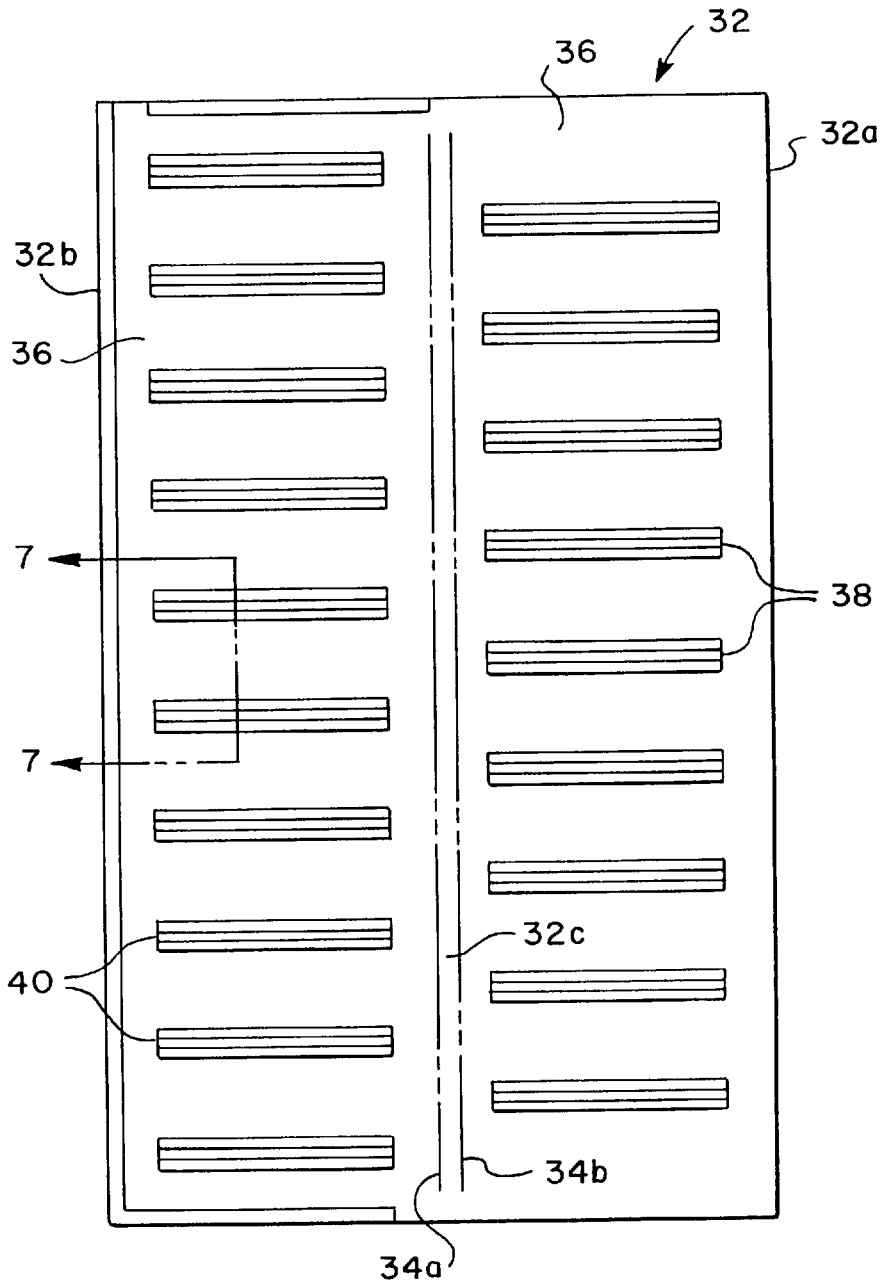
FIG. 6 is a top plan view of a plate from which the conduit of FIG. 2 is assembled.
Figure 7:
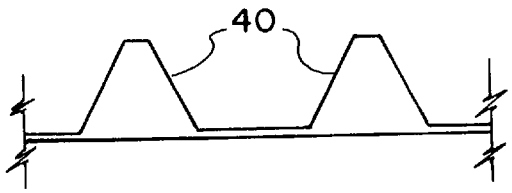
FIG. 7 is a sectional view, taken along the line 7—7 of FIG. 6.

Referring also to FIGS. 6 and 7, tube 12 is assembled by bending a relatively flat plate 32 upwardly along an axis 34*a* and folding a right portion 32*a* of plate 32 (as viewed in FIG. 6) along an axis 34*b* over the top of a left portion 32*b* of plate 32. Portion 32*c* of plate 32 is intermediate portions 32*a*, 32*b* and is defined by axes 34*a*, 34*b*. Plate 32 has a relatively flat major surface 36, punctuated by plural first ridges 38 on right portion 32*a* and plural second ridges 40 on left portion 32*b*. Ridges 38, 40 have a generally triangular cross-section and are staggered so that when right portion 32*a* is folded over the top of left portion 32*b*, each ridge 38 is intermediate adjacent ridges 40, ridges 38 are in contact with major surface 36 of left portion 32*b* and ridges 40 are in contact with major surface 36 of right portion 32*a*, as can be best seen in FIG. 3. The apex of each ridge 38 is braze-connected to major surface 36 of left portion 32*b*, as indicated at 42 in FIG. 3, and the apex of each ridge 40 is braze-connected to major surface 36 of right portion 32*a*, as indicated at 44 in FIG. 3. Each channel 30 is defined by adjacent ridges 38, 40 and by facing major surfaces 36 of right and left portions 32*a*, 32*b*, as can be best seen in FIG. 3.

As can be best seen in FIGS. 4 and 5, right portion 32*a* (which defines the top portion of tube 12) has an extension lip 46, which overlaps one side of left portion 32*b* (which defines the bottom portion of tube 12) and forms a part of side of 12*d* of tube 12. Portions 32*a*, 32*b* are further joined by braze-connecting lip 46 to portion 32*b* along side 12*d* and by brazing along ends 12*a*, 12*b*. Side 12*c* (FIGS. 2, 3 and 5) is defined by portion 32*c* (FIG. 6).

Figure 2:
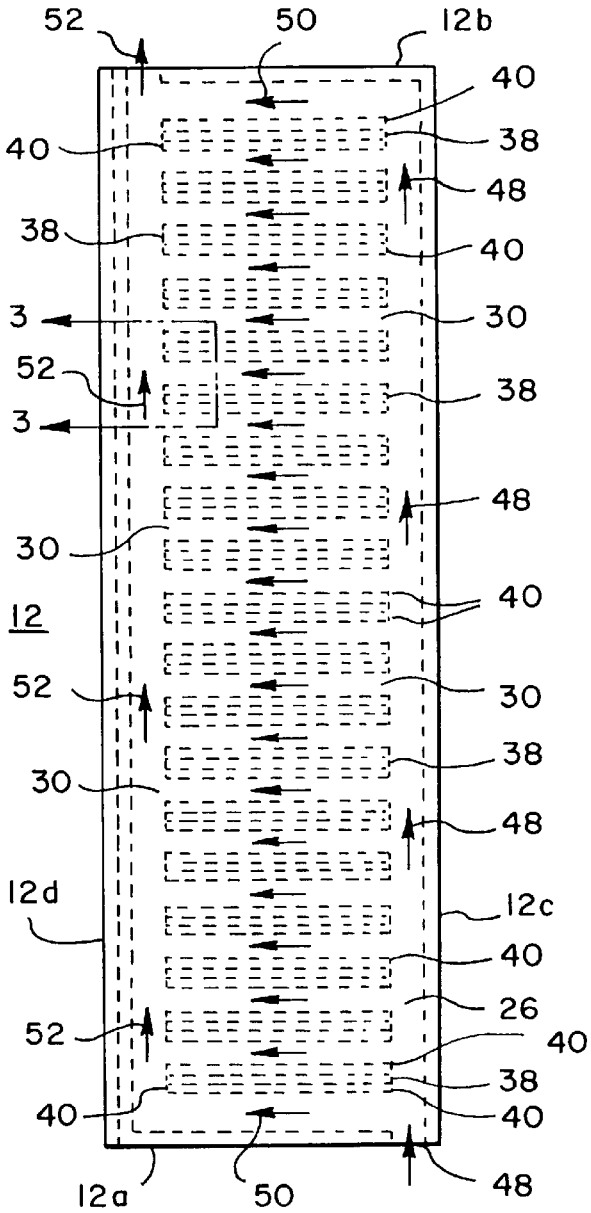
FIG. 2 is a top plan view of a relatively flat fluid conduit, according to the present invention, for use in the heat exchanger of FIG. 1.
Figure 3:
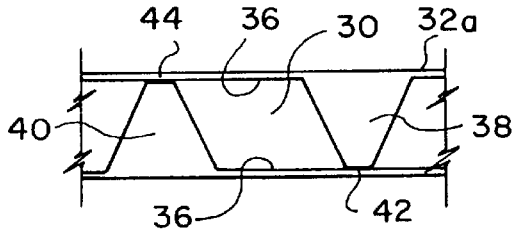
FIG. 3 is a sectional view, taken along the line 3—3 of FIG. 2.

In operation, heat transfer fluid flowing into tube 12 through inlet opening 22 flows into supply channel 26. Fluid flows through supply channel 26 in the direction of arrows 48 (FIG. 2). Fluid also flows across tube 26 through the various channels 30, as indicated by flow arrows 50, into drain channel 28, whereupon the fluid is exhausted from tube 12 through outlet opening 24, as indicated by flow arrows 52. Therefore, the flow of heat transfer fluid through tube 12 is along the major dimension thereof in supply and drain channels 26 and 28, but along the minor dimension thereof in heat transfer channels 30. Because channels 30 extend along the minor dimension of tube 12, their lengths can be made relatively short so that the hydraulic diameter of each channel 30 can be made relatively small for enhanced heat transfer without unwanted pressure drops. The length of tube 12 along its major dimension is preferably at least six times greater than the length of each channel 30 along a minor dimension of tube 12. Heat transfer between the fluid inside tube 12 and an external fluid, such as air, flowing across the outside of tube 12 occurs for the most part as the internal heat transfer fluid flows through channels 30. As can be best seen in FIG. 2, supply and drain channels 26 and 28 have a substantially rectangular cross-section and extend the entire length of tube 12, as measured along the major dimension of tube 12. Supply and drain channels 26 and 28 have a substantially constant cross-sectional area (e.g., 0.005–0.200 square inch) along their respective lengths.

Figure 8:
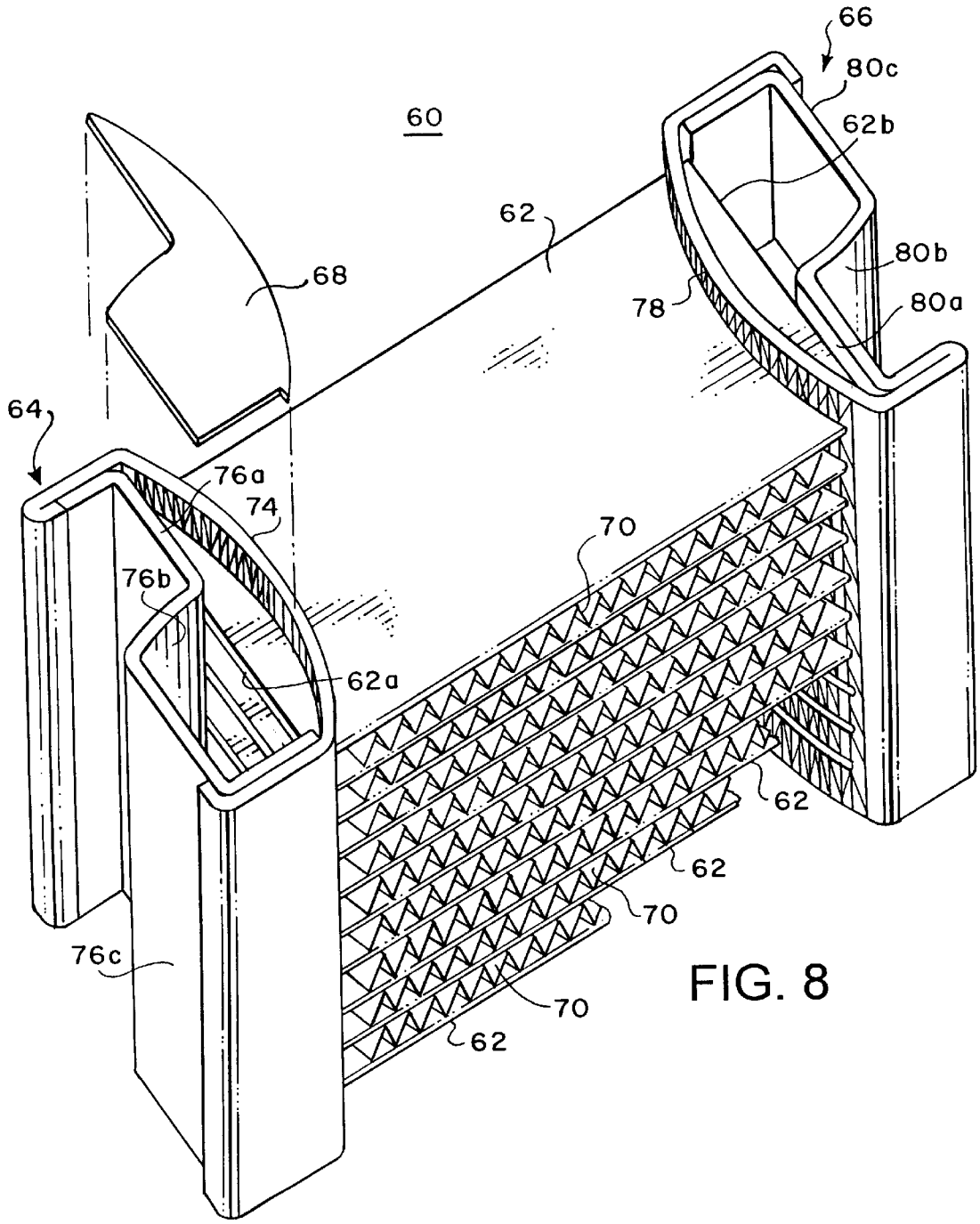
FIG. 8 is a perspective view of an alternate embodiment of a heat exchanger with plural relatively flat fluid conduits, according to the present invention.
Figure 9:
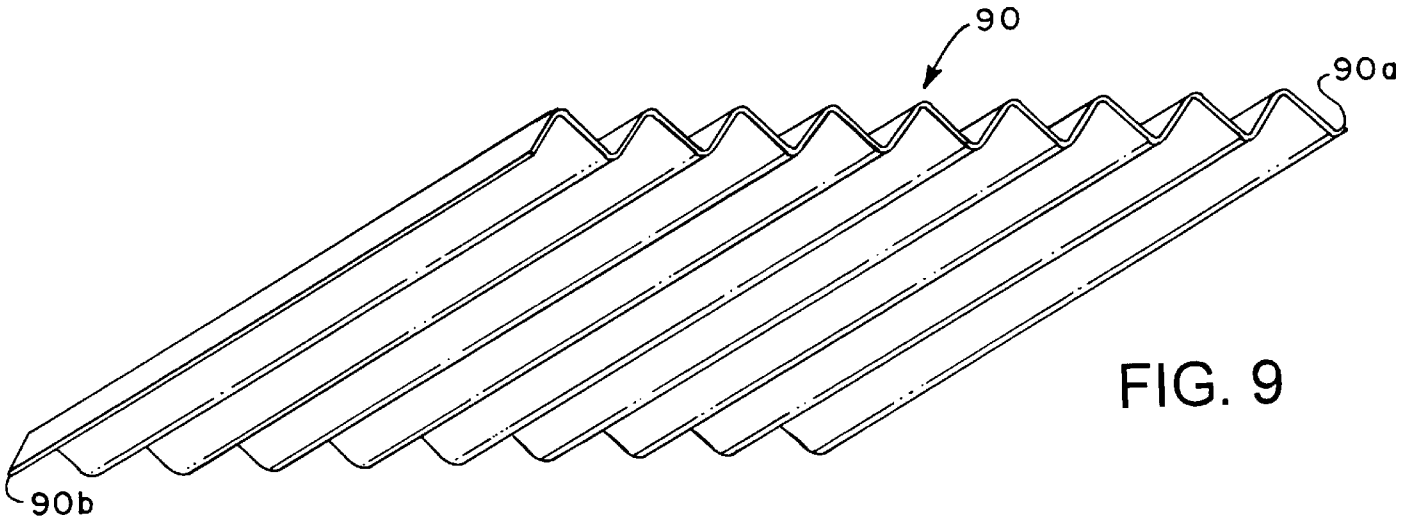
FIG. 9 is a perspective view of a corrugated member located in each of the fluid conduits of the heat exchanger of FIG. 8.
Figure 17:
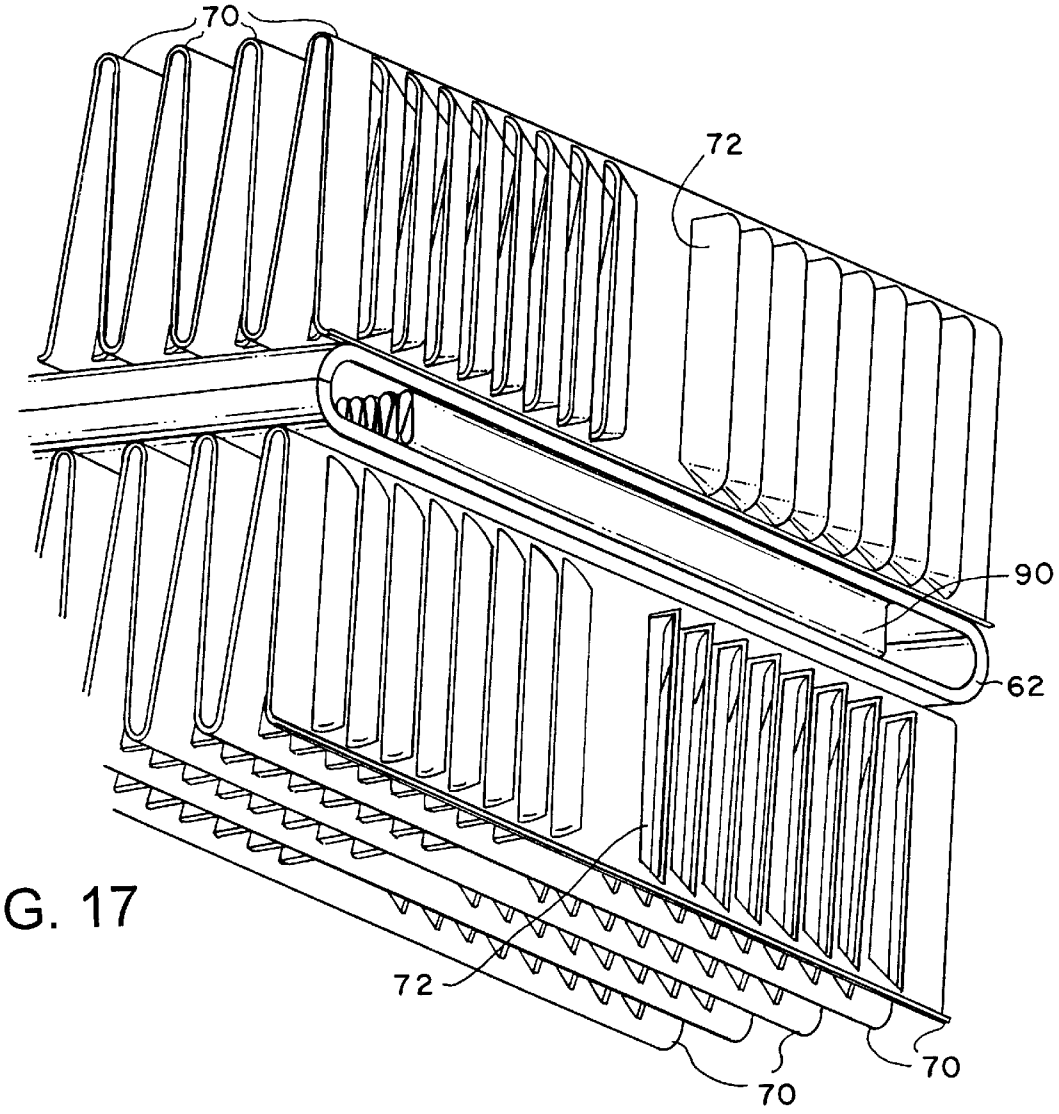
FIG. 17 is a detailed perspective view of a portion of the heat exchanger of FIG. 8, showing serpentine, louvered fins between adjacent ones of the fluid conduits.

Referring now to FIG. 8, an alternate embodiment of a heat exchanger 60, according to the present invention, is comprised of a plurality of elongated tubes 62 of non-circular cross-section, extending between opposed inlet and outlet headers 64 and 66, respectively. Tubes 62 are preferably made of metal, such as aluminum or copper, with a cladding suitable for controlled atmosphere brazing. Each tube 62 is open at opposed ends 62*a*, 62*b* thereof Inlet and outlet headers 64 and 66 function as support members for supporting the weight of tubes 62. Inlet and outlet headers 64 and 66 have top and bottom caps 68 to close off the top and bottom of each header 64, 66. A plurality of heat transfer enhancing, serpentine fins 70 extend between and are bonded, for example, by brazing, to adjacent ones of tubes 62 and are supported thereby. Fins 70 are preferably made of metal, such as aluminum or copper, and are formed with heat transfer enhancing louvers 72, as can be best seen in FIG. 17. Although not shown in FIG. 8, heat exchanger 60 further includes a top plate and a bottom plate. The uppermost fins 70 are bonded to the top plate and to the uppermost tube 62. The lowermost fins 70 are bonded to the lowermost tube 62 and to the bottom plate.

In accordance with a feature of the invention, inlet header 64 has a curved front wall 74 and an undulating rear wall comprised of portions 76*a*, 76*b* and 76*c*. Similarly, outlet header 66 has a curved front wall 78 in facing relationship with front wall 74 and an undulating rear wall comprised of portions 80*a*, 80*b* and 80*c*. Portion 76*a* projects toward front wall 74 and is joined, preferably by brazing, to one end 62*a* of tube 62, to close off one side of inlet header 64 and the corresponding side of tube 62 at end 62*a*. Similarly, portion 80*a* projects toward front wall 78 and is joined, preferably by brazing, to an opposite end 62*b* of tube 62, to close off one side of outlet header 66 and the corresponding side of tube 62 at end 62*b*. Closing off one side of each tube 62 at its end 62*a* defines an inlet opening on the open side of end 62*a* and closing one side of each tube 62 at its opposite end 62*b* defines an outlet opening on the open side of end 62*b*. The inlet opening is on an opposite side of tube 62 from the outlet opening. Front walls 74, 78 have plural slots for receiving respective ends of each conduit 62. End 62*a* of each conduit 62 extends through a corresponding slot in front wall 74, while end 62*b* of each conduit 62 extends through a corresponding slot in front wall 78. End 62*a* of each conduit 62 penetrates through the corresponding slot in front wall 74 until it contacts rear wall portion 76*a* and end 62*b* of each conduit 62 penetrates through the corresponding slot in front wall 78 until it contacts rear wall portion 80*a*.

Referring to FIGS. 9–15, the process for assembling each conduit 62 will now be described in greater detail. As can be best seen in FIG. 9, a flat metal sheet having a major dimension and a minor dimension is formed with a plurality of corrugations to provide a corrugated member 90. Member 90 is then collapsed to compress the corrugations into a tightly packed configuration, which defines plural teardrop-shaped passages 92 extending along the major dimension of corrugated member 90. Respective opposed edges 90*a* and 90*b* of member 90 are outwardly turned, as can be best seen in FIG. 10.

Conduit 62 is assembled by bending a relatively flat plate 94 (FIG. 11), first along an axis 96*a* and then along an axis 96*b*, so that a right portion 94*a* of plate 94 (as viewed in FIG. 11) is folded over the top of a left portion 94*b* of plate 94. Portion 94*c* of plate 94 is intermediate portions 94*a* and 94*b* and is defined by axes 96*a*, 96*b*. Opposed sides of plate 94 are defined by slightly upturned edges 98*a*, 98*b*. As can be best seen in FIGS. 12–14, right portion 94*a* defines the top portion of tube 62 and left portion 94*b* defines the bottom portion of tube 62. Portion 94*c* defines one side of tube 62.

Figure 10:
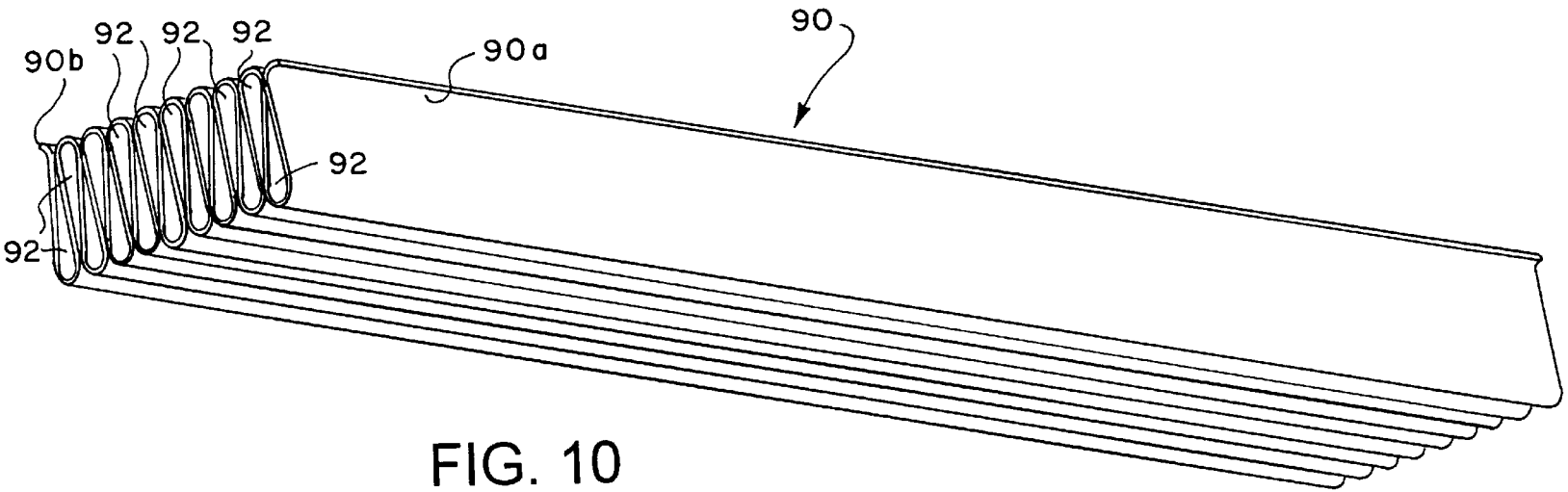
FIG. 10 is a perspective view of the corrugated member of FIG. 9, showing the member after it has been compressed into a tightly packed configuration.
Figure 11:
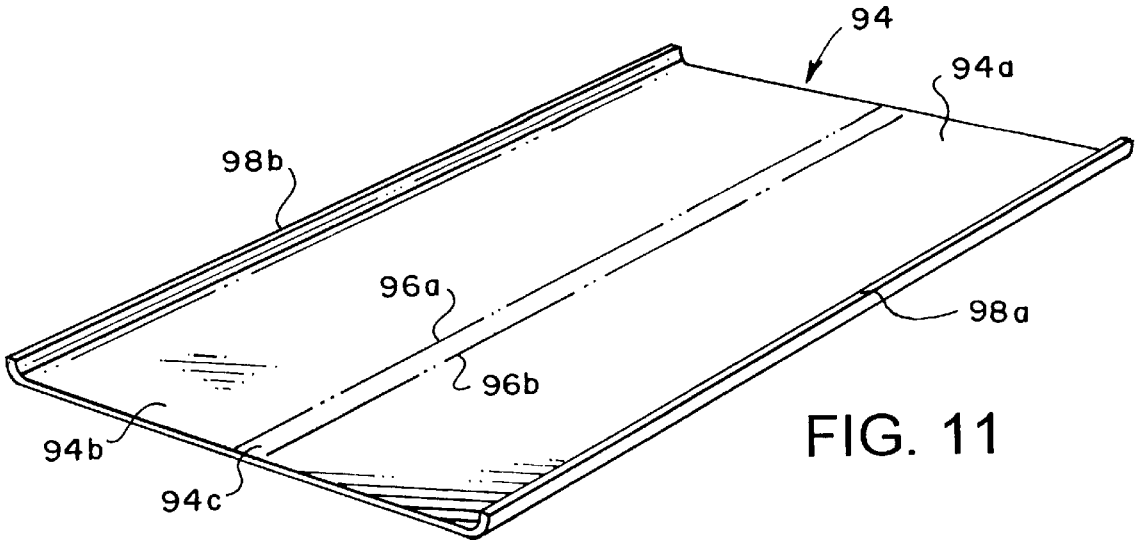
FIG. 11 is a perspective view of a plate from which each of the conduits shown in FIG. 8 is assembled.
Figure 12:
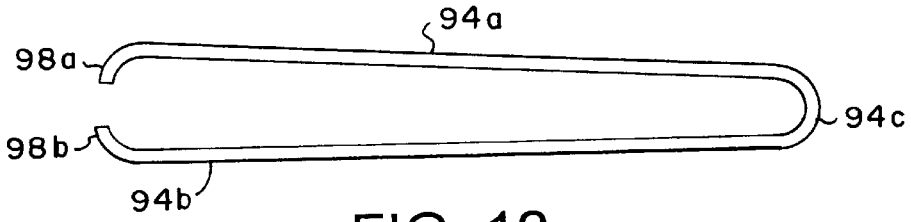
FIGS. 12–14 are respective elevation views, showing the steps in the process of assembling one of the fluid conduits shown in FIG. 8.
Figure 13:
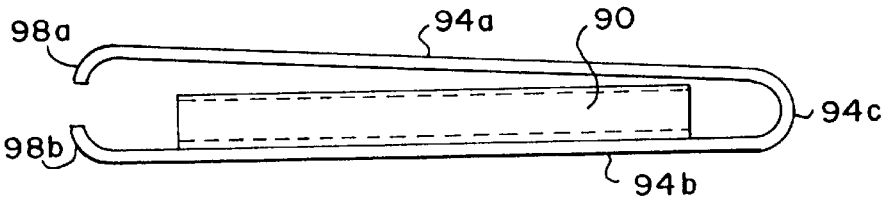
Figure 14:
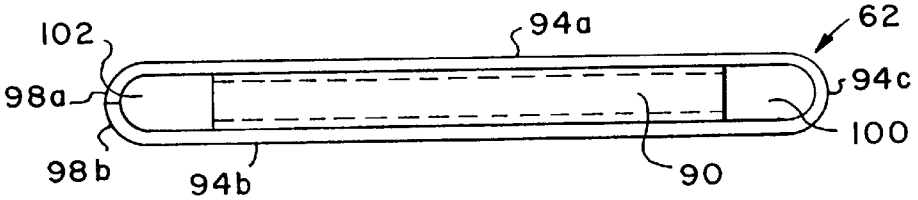

After plate 94 has been folded, as shown in FIG. 12, corrugated member 90, after being collapsed as shown in FIG. 10, is inserted into the folded plate 94. Plate 94 has a major dimension and a minor dimension. Corrugated member 90 also has a major dimension and a minor dimension. The major dimension of corrugated member 90 is substantially the same as the major dimension of plate 94 so that when member 90 is inserted inside folded plate 94, member 90 extends substantially the entire length of plate 94 from one end thereof to the other. However, the minor dimension of corrugated member 90 is substantially less than the minor dimension of the folded plate 94, as can be best seen in FIGS. 13 and 14, so that there is a space 100, 102 between member 90 and folded plate 94 on each side of member 90. Edges 98*a*, 98*b* are then pressed together, as shown in FIG. 14, and are joined together, preferably by seam welding, along the entire major dimension of folded plate 94 to form the other side of tube 62. Corrugated member 90 is in contact with the cladded inner surface of tube 62 on both the top and bottom of tube 62, as can be best seen in FIGS. 14, 15 and 15A.

Figure 15:
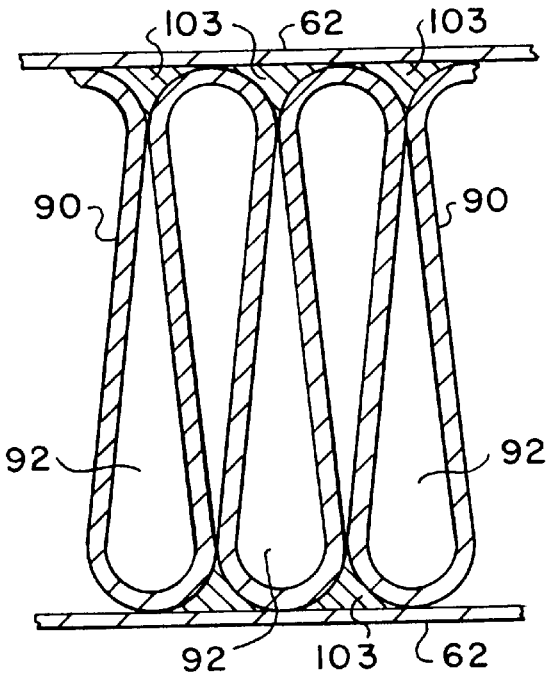
FIG. 15 is a detailed elevation view of the interior of a fluid conduit, showing teardrop-shaped heat transfer channels within the conduit.
Figure 15A:
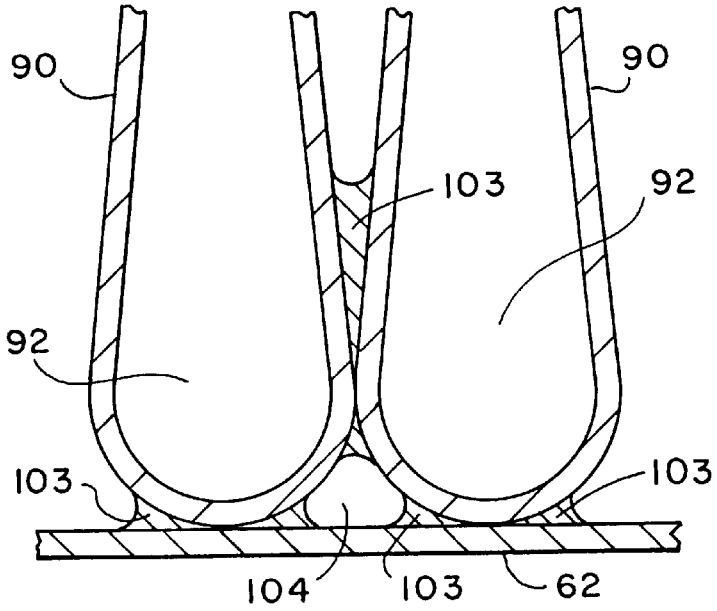
FIG. 15A is a detailed elevation view of the interior of a fluid conduit, showing a secondary heat transfer channel formed by braze-connecting the corrugated member to an interior wall of the conduit.

The assembled tube 62 (FIG. 14) is then passed through a brazing oven, which melts the cladded material on the inner surface of tube 62. As shown at 103 in FIG. 15, when this cladding material melts, it fills the gaps between the corrugations and the inner wall of tube 62, so that teardrop-shaped heat transfer channels are defined by passages 92 along the minor dimension of tube 62. When the material 103 solidifies, it forms a secure bond between corrugated member 90 and the inner surface of conduit 62. In some instances, as shown in FIG. 15A, material 103 may not completely fill the gaps between the corrugations and the inner surface of tube 62. In those instances, generally circular secondary heat transfer channels 104 may be formed. Channels 104 also extend along the minor dimension of tube 62.

Figure 16:
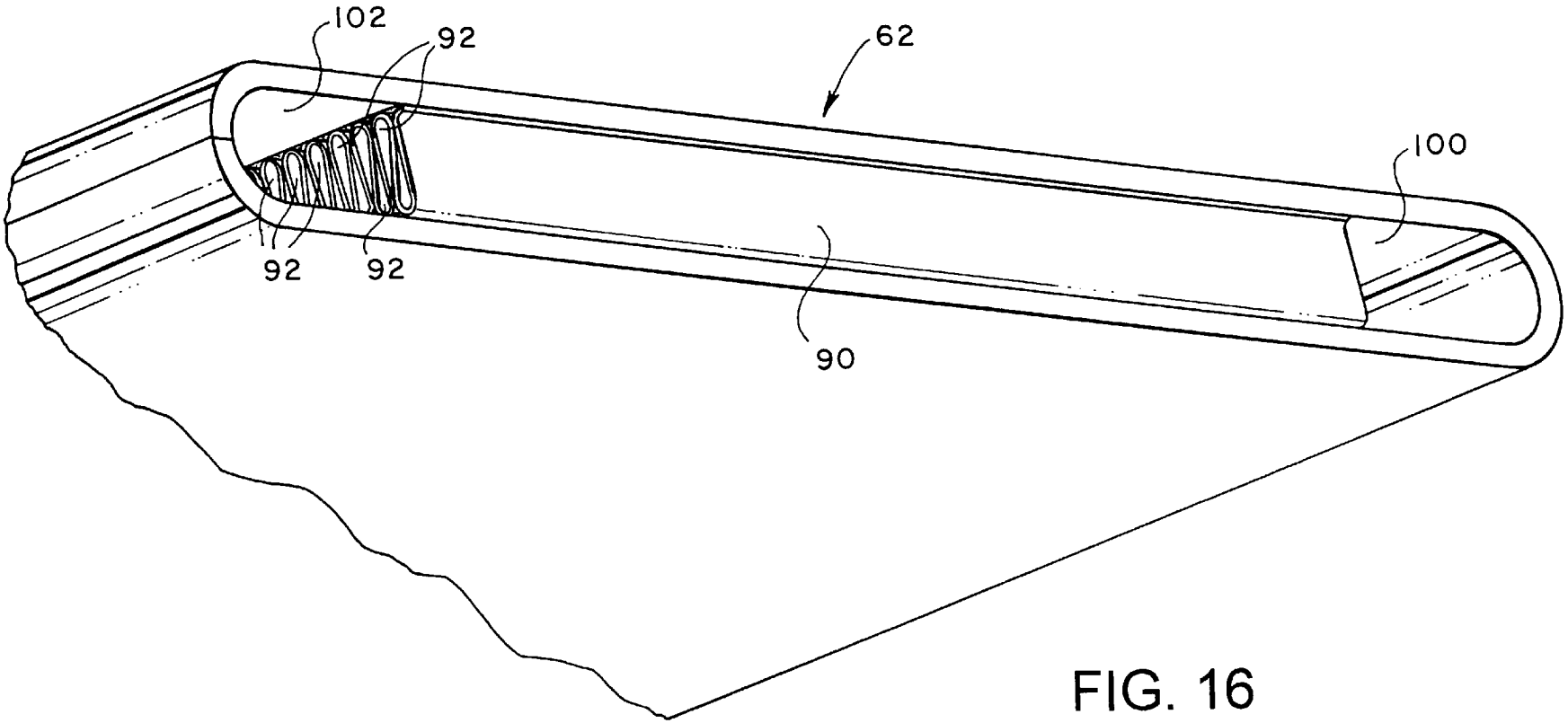
FIG. 16 is a perspective view of an assembled fluid conduit.

As can be best seen in FIG. 16, corrugated member 90 is located within tube 62 such that spaces 100, 102 between member 90 and the sides of tube 62 extend along substantially the entire major dimension of tube 62. Space 100 defines a supply channel, extending substantially the entire major dimension of tube 62 on one side thereof. Space 102 on the other side of member 90 defines a drain channel, which also extends along substantially the entire major dimension of tube 62 on the opposite side thereof. The teardrop-shaped heat transfer channels 92 extend along the minor dimension of tube 62 and communicate between supply channel 100 and drain channel 102.

In accordance with a feature of the invention, each heat transfer channel 92 has a relatively small hydraulic diameter, preferably in a range of 0.01 to 0.20 inch. However, in heat exchangers used in large air handling units, such as those used in commercial applications, the hydraulic diameter of each heat transfer channel 92 may be greater than 0.20 inch. Supply and drain channels 100, 102 each have a substantially greater cross-sectional area and length than the cross-sectional area and length of each heat transfer channel 92 so as to maintain sufficient flow rate through channels 92 without excessive pressure drops. For example, the cross-sectional area of each channel 100, 102 is preferably in a range of approximately 5–100 times greater than the cross-sectional area of each channel 92. The length of tube 62 along its major dimension is preferably at least six times greater than the length of each channel 92 along the minor dimension of tube 62.

Figure 18A:
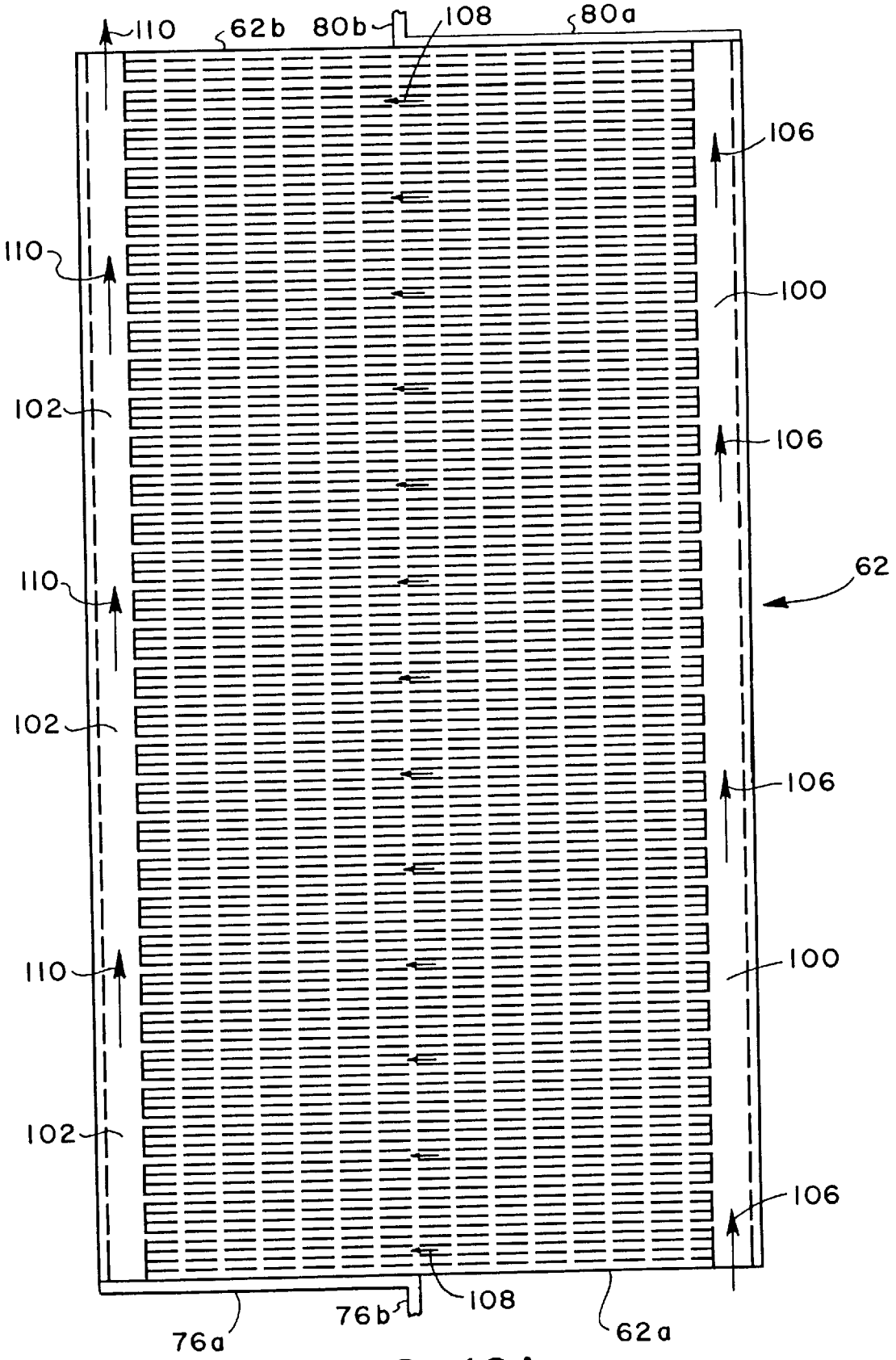
FIG. 18A is a diagram, illustrating the flow paths of heat transfer fluid within the conduit.
Figure 18B:
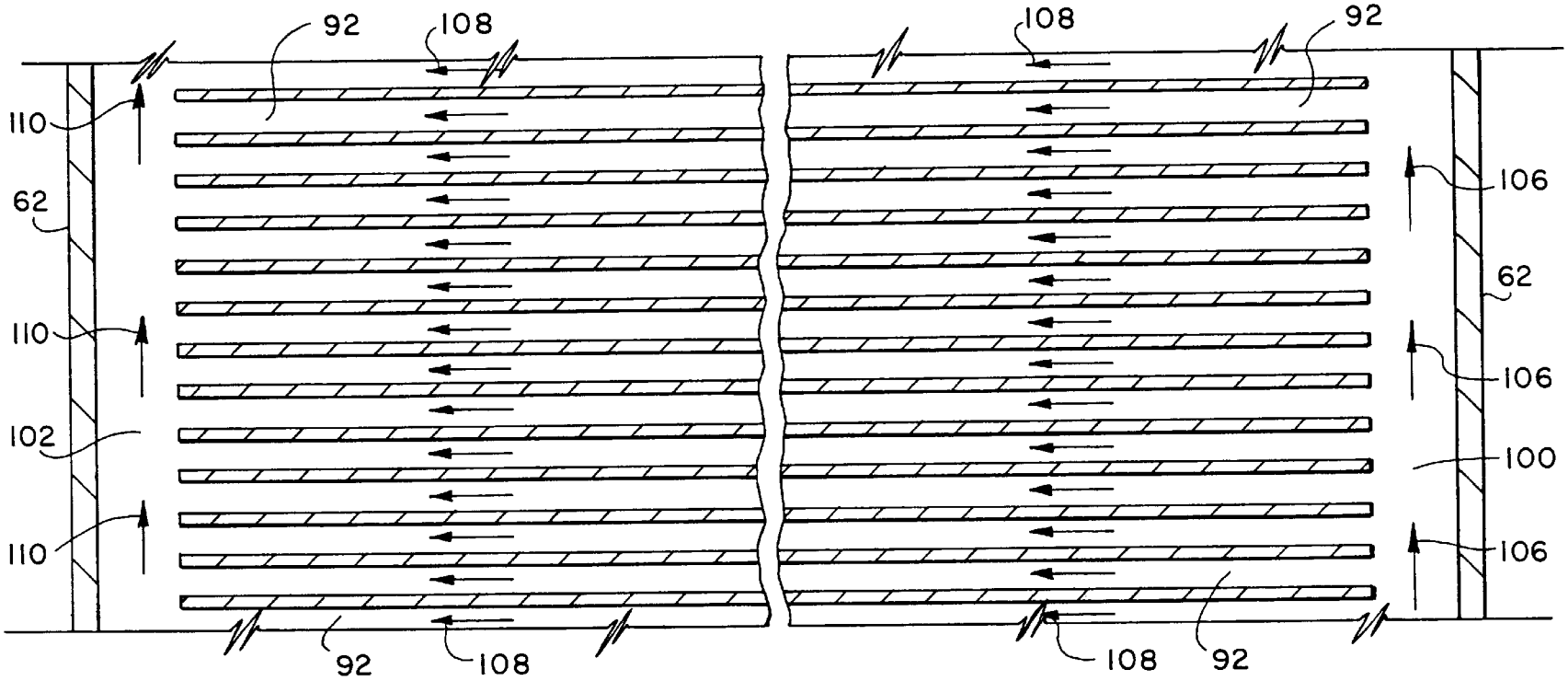
FIG. 18B is a detailed view of a portion of the diagram of FIG. 18A, illustrating the flow paths of heat transfer fluid within the conduit.

Referring now to FIGS. 8, 18A and 18B, in operation, heat transfer fluid flowing from inlet header 64 into tube 62 through the inlet opening at end 62*a* flows into supply channel 100. Fluid flows through supply channel 100 in the direction of arrows 106. Fluid also flows across tube 62 through the various channels 92, as indicated by flow arrows 108, into drain channel 102. Fluid flowing through drain channel 102 is indicated by flow arrows 110. Fluid flows out of tube 62 through the outlet opening at end 62*b* and into outlet header 66. Therefore, the flow of heat transfer fluid through tube 62 is generally along the major dimension of tube 62 in supply and drain channels 100, 102 and generally along the minor dimension of tube 62 in heat transfer channels 92. Heat transfer between the fluid inside tube 62 and an external fluid, such as air, flowing across the outside of tube 62 occurs for the most part as the internal heat transfer fluid flows through channels 92.

In accordance with the present invention, an improved heat exchanger with relatively flat fluid conduits is provided. By configuring the heat transfer channels within each conduit to be relatively short in relation to the length of the corresponding conduit, the heat transfer channels can be made with relatively small hydraulic diameters for improved heat transfer efficiency without the unwanted pressure drops typically associated with prior art parallel flow heat exchanger conduits of relatively small hydraulic diameter. Such unwanted pressure drops are reduced by providing each conduit with supply and drain channels having substantially greater cross-sectional areas than the cross-sectional areas of the individual heat transfer channels, such that the supply and drain channels maintain sufficient fluid flow rate through the heat transfer channels without excessive pressure drops. The present invention has application in various types of heat exchangers used in air conditioning, refrigeration and chilled water systems.

Various embodiments of the invention have now been described in detail, including the best mode for carrying out the invention. Since changes in and modifications to the above-described embodiments may be made without departing from the nature, spirit and scope of the invention, the invention is not to be limited to said details, but only by the appended claims and their equivalents.

We claim:

1. A heat exchanger having at least one conduit of non-circular cross-section adapted to accommodate passage of heat transfer fluid therethrough and support means for supporting said conduit, said conduit having a major dimension and a minor dimension, inlet and outlet openings, a supply channel extending generally along said major dimension and communicating with said inlet opening to direct heat transfer fluid flowing through said inlet opening into said conduit, a drain channel extending generally along said major dimension and communicating with said outlet opening to direct heat transfer fluid out of said conduit through said outlet opening, and plural heat transfer channels, each of which extends generally along said minor dimension between said supply channel and said drain channel, said major dimension being substantially greater than said minor dimension, such that each heat transfer channel has a relatively short length compared to a length of said conduit along said major dimension, at least one of said heat transfer channels having a hydraulic diameter of less than about 0.105 inch.

2. The heat exchanger of claim 1 wherein said supply channel and said drain channel each have a substantially greater cross-sectional area than each of said heat transfer channels.

3. The heat exchanger of claim 1 wherein said conduit is a relatively flat tube.

4. The heat exchanger of claim 3 wherein said supply channel and said drain channel are located on respective opposed sides of said tube and extend substantially the entire major dimension of said tube.

5. The heat exchanger of claim 1 wherein said conduit has a length along said major dimension which is at least six times greater than a length of each heat transfer channel along said minor dimension.

6. The heat exchanger of claim 1 wherein at least one of said supply channel and said drain channel has a cross-sectional area which is at least five times greater than a cross-sectional area of each of said heat transfer channels.

7. The heat exchanger of claim 6 wherein a ratio of the cross-sectional area of said at least one of said supply channel and said drain channel to the cross-sectional area of each of said heat transfer channels is in a range of about 5:1 to 100:1.

8. The heat exchanger of claim 1 wherein said supply channel and said drain channel extend along respective opposed sides of said conduit, said inlet opening being located in one end of said conduit and proximate to one side of said conduit, said outlet opening being located in an opposite end of said conduit from said one end and proximate to an opposite side of said conduit from said one side.

9. The heat exchanger of claim 1 wherein said at least one of said heat transfer channels has a hydraulic diameter in a range of about 0.010 inch to about 0.014 inch.

10. The heat exchanger of claim 9 wherein said at least one heat transfer channel has a hydraulic diameter of about 0.010 inch.

11. The heat exchanger of claim 1 wherein said conduit is assembled by folding a relatively flat plate along a major axis thereof which is intermediate opposed side edges of said plate to form one side of said conduit, inserting said corrugated member into said conduit, joining opposed side edges of said plate to define an opposite side of said conduit from said one side and joining said corrugated member to said conduit.

12. A heat exchanger having at least one conduit of non-circular cross-section adapted to accommodate passage of heat transfer fluid therethrough and support means for supporting said conduit, said conduit having a major dimension and a minor dimension, opposed ends spaced apart by said major dimension and opposed sides spaced apart by said minor dimension, inlet and outlet openings, and a corrugated member located in said conduit, said corrugated member having plural corrugations arranged in a tightly packed configuration to define teardrop-shaped heat transfer channels extending along said minor dimension, said corrugated member having a length extending along said major dimension between said ends and a width extending only partially between said sides to define a supply channel intermediate said corrugated member and one side and to define a drain channel intermediate said corrugated member and an opposite side, said supply channel extending along said major dimension and communicating with said inlet opening to direct heat transfer fluid flowing through said inlet opening into said conduit, said drain channel extending along said major dimension and communicating with said outlet opening to direct heat transfer fluid out of said conduit through said outlet opening, said heat transfer channels being adapted to direct heat transfer fluid from said supply channel to said drain channel in a transverse direction with respect to said major dimension.

13. A heat exchanger having at least one conduit of non-circular cross-section adapted to accommodate passage of heat transfer fluid therethrough and support means for supporting said conduit, said conduit having a major dimension and a minor dimension, opposed ends spaced apart by said major dimension and opposed sides spaced apart by said minor dimension, inlet and outlet openings, and a corrugated member located in said conduit, said corrugated member having plural corrugations defining plural heat transfer channels extending along said minor dimension, said corrugated member having a length extending along said major dimension between said ends and a width extending only partially between said sides to define a supply channel intermediate said corrugated member and one side and to define a drain channel intermediate said corrugated member and an opposite side, said supply channel extending along said major dimension and communicating with said inlet opening to direct heat transfer fluid flowing through said inlet opening into said conduit, said drain channel extending along said major dimension and communicating with said outlet opening to direct heat transfer fluid out of said conduit through said outlet opening, said heat transfer channels being adapted to direct heat transfer fluid from said supply channel to said drain channel in a transverse direction with respect to said major dimension, said support means being comprised of inlet and outlet headers, said conduit extending between said inlet and outlet headers along said major dimension, said inlet header being in fluid communication with said inlet opening, whereby heat transfer fluid enters said conduit, said outlet header being in fluid communication with said outlet opening, whereby heat transfer fluid exits said conduit, each of said inlet and outlet headers having a width sufficient to accommodate said minor dimension of said conduit, said inlet header having means for blocking said drain channel at one end of said conduit to inhibit heat transfer fluid from entering said drain channel, said outlet header having means for blocking said supply channel at an opposite end of said conduit to inhibit heat transfer fluid in said supply channel from entering said outlet header.

14. The heat exchanger of claim 12 wherein said corrugated member is inserted into said conduit and is joined thereto during assembly of said conduit.

15. The heat exchanger of claim 13 wherein said inlet and outlet headers each have curved front walls in facing relationship, said front wall of said inlet header having a slot through which said one end of said conduit extends into said inlet header, said front wall of said outlet header also having a slot through which said opposite end of said conduit extends into said outlet header, said inlet header having a first rear wall, a portion of which defines said means for blocking said drain channel, said one end of said conduit being joined to said portion of said first rear wall, whereby said drain channel is blocked, said outlet header having a second rear wall, a portion of which defines said means for blocking said supply channel, said opposite end of said conduit being joined to said portion of said second rear wall, whereby said supply channel is blocked.

16. In a heat exchanger, a conduit of non-circular cross-section adapted to accommodate passage of heat transfer fluid therethrough, said conduit having a major dimension and a minor dimension, inlet and outlet openings, a supply channel extending generally along said major dimension and communicating with said inlet opening to direct heat transfer fluid flowing through said inlet opening into said conduit, a drain channel extending generally along said major dimension and communicating with said outlet opening to direct heat transfer fluid out of said conduit through said outlet opening, and plural heat transfer channels, each of which extends generally along said minor dimension between said supply channel and said drain channel, said major dimension being substantially greater than said minor dimension, such that each heat transfer channel has a relatively short length compared to a length of said conduit along said major dimension, at least one of said heat transfer channels having a hydraulic diameter of less than about 0.105 inch.

17. The conduit of claim 16 wherein said supply channel and said drain channel each having a substantially greater cross-sectional area than each of said heat transfer channels.

18. The conduit of claim 16 wherein said conduit is a relatively flat tube.

19. The conduit of claim 18 wherein said supply channel and said drain channel are located on respective opposed sides of said tube and extend substantially the entire major dimension of said tube.

20. The conduit of claim 16 wherein said conduit has a length along said major dimension which is at least six times greater than a length of each heat transfer channel along said minor dimension.

21. The conduit of claim 16 wherein at least one of said supply channel and said drain channel has a cross-sectional area which is at least five times greater than a cross-sectional area of each of said heat transfer channels.

22. The conduit of claim 21 wherein a ratio of the cross-sectional area of said at least one of said supply channel and said drain channel to the cross-sectional area of each of said heat transfer channels is in a range of about 5:1 to 100:1.

23. The conduit of claim 16 wherein said supply channel and said drain channel extend along respective opposed sides of said conduit, said inlet opening being located in one end of said conduit and proximate to one side of said conduit, said outlet opening being located in an opposite end of said conduit from said one end and proximate to an opposite side of said conduit from said one side.

24. The conduit of claim 16 wherein said at least one of said heat transfer channels has a hydraulic diameter in a range of about 0.010 inch to about 0.014 inch.

25. The conduit of claim 24 wherein said at least one heat transfer channel has a hydraulic diameter of about 0.010 inch.

26. The conduit of claim 24 wherein said conduit is assembled by folding a relatively flat plate along a major axis thereof which is intermediate opposed side edges of said plate to form one side of said conduit, inserting said corrugated member into said conduit, joining opposed side edges of said plate to form an opposite side of said conduit from said one side and joining said corrugated member to said conduit.

27. In a heat exchanger, a conduit of non-circular cross-section adapted to accommodate passage of heat transfer fluid therethrough, said conduit having a major dimension and a minor dimension, opposed ends spaced apart by said major dimension and opposed sides spaced apart by said minor dimension, inlet and outlet openings, and a corrugated member located in said conduit, said corrugated member having plural corrugations defining plural heat transfer channels extending along said minor dimension, said corrugated member having a length extending along said major dimension between said ends and a width extending only partially between said sides to define a supply channel intermediate said corrugated member and one side and to define a drain channel intermediate said corrugated member and an opposite side, said supply channel extending along said major dimension and communicating with said inlet opening to direct heat transfer fluid flowing through said inlet opening into said conduit, said drain channel extending along said major dimension and communicating with said outlet opening to direct heat transfer fluid out of said conduit through said outlet opening, said heat transfer channels being adapted to direct heat transfer fluid from said supply channel to said drain channel in a transverse direction with respect to said major dimension, said corrugations being arranged in a tightly packed configuration to define teardrop-shaped heat transfer channels.

28. The heat exchanger of claim 27 wherein said corrugated member is inserted into said conduit and is joined thereto during assembly of said conduit.

29. A heat exchanger having at least one conduit of non-circular cross-section adapted to accommodate passage of heat transfer fluid therethrough and opposed inlet and outlet headers supporting said conduit, said conduit having a major dimension and a minor dimension, inlet and outlet openings, a supply channel extending along said major dimension and communicating with said inlet opening to direct heat transfer fluid from said inlet header into said conduit, a drain channel extending along said major dimension and communicating with said outlet opening to direct heat transfer fluid out of said conduit into said outlet header, and plural heat transfer channels extending along said minor dimension between said supply channel and said drain channel, said conduit extending between said inlet and outlet headers along said major dimension, each of said inlet and outlet headers having a width sufficient to accommodate said minor dimension of said conduit, said inlet header having means for blocking said drain channel at one end of said conduit to inhibit heat transfer fluid from entering said drain channel, said outlet header having means for blocking said supply channel at an opposite end of said conduit to inhibit heat transfer fluid in said supply channel from entering said outlet header.

30. The heat exchanger of claim 29 wherein said inlet and outlet headers each have curved front walls in facing relationship, said front wall of said inlet header having a slot through which said one end of said conduit extends into said inlet header, said front wall of said outlet header also having a slot through which said opposite end of said conduit extends into said outlet header, said inlet header having a first rear wall, a portion of which defines said means for blocking said drain channel, said one end of said conduit being joined to said portion of said first rear wall, whereby said drain channel is blocked, said outlet header having a second rear wall, a portion of which defines said means for blocking said supply channel, said opposite end of said conduit being joined to said portion of said second rear wall, whereby said supply channel is blocked.

31. A heat exchanger having at least one conduit of non-circular cross-section adapted to accommodate passage of heat transfer fluid therethrough and support means for supporting said conduit, said conduit having a major dimension and a minor dimension, inlet and outlet openings, and a corrugated member located in said conduit, said corrugated member having plural corrugations extending generally transversely with respect to said major dimension to define plural heat transfer channels, said conduit having opposed ends spaced apart by said major dimension and opposed sides spaced apart by said minor dimension, said corrugations extending only partially between said sides to define a supply channel intermediate said corrugated member and one side of said conduit and to define a drain channel intermediate said corrugated member and an opposite side of said conduit, said supply channel extending generally along said major dimension and communicating with said inlet opening to direct heat transfer fluid flowing through said inlet opening into said conduit, said drain channel extending generally along said major dimension and communicating with said outlet opening to direct heat transfer fluid out of said conduit through said outlet opening, each of said heat transfer channels extending generally along said minor dimension between said supply channel and said drain channel, said major dimension being substantially greater than said minor dimension, such that each heat transfer channel has a relatively short length compared to a length of said conduit along said major dimension.

32. The heat exchanger of claim 31 wherein at least one of said heat transfer channels has a hydraulic diameter of less than about 0.015 inch.

33. A heat exchanger having plural conduits of non-circular cross-section adapted to accommodate passage of heat transfer fluid therethrough and support means for supporting said conduits, each of said conduits having a major dimension and a minor dimension, inlet and outlet openings, a supply channel extending generally along said major dimension and communicating with said inlet opening to direct heat transfer fluid flowing through said inlet opening into said conduit, a drain channel extending generally along said major dimension and communicating with said outlet opening to direct heat transfer fluid out of said conduit through said outlet opening, and plural heat transfer channels, each of said heat transfer channels extending generally along said minor dimension between said supply channel and said drain channel, said major dimension being substantially greater than said minor dimension, such that each heat transfer channel has a relatively short length compared to a length of said conduit along said major dimension, said heat exchanger further including plural serpentine fins extending between and joined to adjacent ones of said conduits.

34. The heat exchanger of claim 33 wherein at least one of said heat transfer channels of each conduit has a hydraulic diameter of less than about 0.015 inch.

35. The heat exchanger of claim 34 wherein said at least one of said heat transfer channels of each conduit has a hydraulic diameter in a range of about 0.010 inch to about 0.014 inch.

36. In a heat exchanger, a conduit of non-circular cross-section adapted to accommodate passage of heat transfer fluid therethrough, said conduit having a major dimension and a minor dimension, inlet and outlet openings, and a corrugated member located in said conduit, said corrugated member having plural corrugations extending generally transversely with respect to said major dimension to defame plural heat transfer channels, said conduit having opposed ends spaced apart by said major dimension and opposed sides spaced apart by said minor dimension, said corrugations extending only partially between said sides to define a supply channel intermediate said corrugated member and one side of said conduit and to define a drain channel intermediate said corrugated member and an opposite side of said conduit, said supply channel extending generally along said major dimension and communicating with said inlet opening to direct heat transfer fluid flowing through said inlet opening into said conduit, said drain channel extending generally along said major dimension and communicating with said outlet opening to direct heat transfer fluid out of said conduit through said outlet opening, each of said heat transfer channels extending generally along said minor dimension between said supply channel and said drain channel, said major dimension being substantially greater than said minor dimension, such that each heat transfer channel has a relatively short length compared to a length of said conduit along said major dimension.

37. The conduit of claim 34 wherein at least one of said heat transfer channels has a hydraulic diameter of less than about 0.015 inch.

* * * * *

UNITED STATES PATENT AND TRADEMARK OFFICE

CERTIFICATE OF CORRECTION

PATENT NO. : 6,016,864
DATED : January 25, 2000
INVENTOR(S) : Bae, et al

It is certified that error appears in the above-identified patent and that said Letters Patent is hereby corrected as shown below:

Column 8, line 40 (*i.e.*, last line of claim 1), change "0.105" to --0.015-- ;

Column 10, line 52 (*i.e.*, last line of claim 16), change "0.105" to --0.015-- ; and Column 14, line 1 (in claim 36), change "defame" to --define-- .

Signed and Sealed this

Thirteenth Day of February, 2001

*Attest:*

Nicholas P. Godici

NICHOLAS P. GODICI

*Attesting Officer*

*Acting Director of the United States Patent and Trademark Office*